US005897922A

United States Patent [19]

Saxena et al.

[11] Patent Number: 5,897,922

[45] Date of Patent: Apr. 27, 1999

[54] METHOD TO MANUFACTURE REINFORCED AXI-SYMMETRIC METAL MATRIX COMPOSITE SHAPES

[75] Inventors: Pawan Saxena, Gloucester; Jonathan C. Beddoes, Ottawa; Ashok K. Koul, Gloucester, all of Canada

[73] Assignee: National Research Council of Canada, Ottawa, Canada

[21] Appl. No.: 08/826,672

[22] Filed: Apr. 7, 1997

[51] Int. Cl.[6] ..... C23C 4/08; B22D 11/00

[52] U.S. Cl. ..... 427/455; 164/465; 427/422; 427/425; 427/427; 427/576; 427/177; 427/178

[58] Field of Search ..... 427/576, 422, 427/455, 425, 427, 199, 200, 203, 205, 206, 180, 177, 178; 164/465

[56] References Cited

U.S. PATENT DOCUMENTS 5,401,539 3/1995 Coombs et al. ..... 427/422

5,480,676 1/1996 Sonoparlak et al. ..... 427/180

*Primary Examiner*—Janyce Bell

*Attorney, Agent, or Firm*—Juliusz Szereszewski

[57] ABSTRACT

A composite part consisting of a metallic matrix and reinforcing fibers is fabricated by the simultaneous winding of the fiber and plasma spraying of the matrix onto a rotating mandrel, wherein an axi-symmetric part is produced with multiple layers of the fibers aligned in the circumferential direction. Single or multiple fiber strands are wound onto a mandrel and simultaneously sprayed with the heated powder matrix material using a thermal spray process. Rotation and translation of the mandrel produces an axi-symmetric composite part. The content of the fiber material in the plasma sprayed matrix is typically up to 40% by volume. The light-weight composite part is produced in a single processing step. The part may be used either directly, or as an insert in other components with or without further densification.

11 Claims, 4 Drawing Sheets

METHOD TO MANUFACTURE REINFORCED AXI-SYMMETRIC METAL MATRIX COMPOSITE SHAPES

FIELD OF THE INVENTION

This invention relates to a method for manufacturing fibre-reinforced components by continuous winding of a fibre and application of a metal matrix by plasma spraying to produce an axi-symmetric shape, with the fibres aligned in the hoop direction.

BACKGROUND OF THE INVENTION

Advances in the applications of current materials demand increased strength and toughness from existing monolithic materials. These requirements may be met by reinforcing the monolithic materials with high strength continuous fibres to produce composites. A composite material body comprises two components: the load bearing high strength fibre and a ductile load distributing matrix. Metallic matrices incorporating high strength ceramic fibres, in particular titanium or aluminum alloys reinforced with SiC fibres, result in composites whose properties can be engineered in terms of strength, stiffness, corrosion resistance, density and ductility. These improved material properties, compared to base monolithic materials, are utilized in different geometries such as flat, curved, circular and other shapes, based on the requirements of the particular structural component. The current fabrication of these composites involves cumbersome multi-step processes, predominantly intended for the manufacture of flat parts.

U.S. Pat. No. 3,615,277 describes a method of manufacturing fibre reinforced articles using monolayer composite tapes. The fibre material is attached to a mandrel and placed in front of a plasma spray. By rotating and translating the mandrel, a homogeneous matrix layer is deposited onto the fibres. On cooling, the tape containing the fibres/matrix monolayer is removed from the mandrel and cut to required shape.

U.S. Pat. No. 4,518,625 describes the use of an arc metal spray gun to spray hot molten metal onto previously aligned fibres on a large drum. The chamber containing the fibre wound drum is evacuated and back filled with argon to provide an inert and contaminant free environment. After spraying, the monolayer is removed and cut to the required dimensions.

Both of these processes are used to make flat components. A multi-layer flat part is produced by stacking several cut monolayers and compacting them by using external pressure and/or temperature. The fibres have to be aligned on the drum or mandrel using organic binders which must be removed through a burn-out cycle prior to densification, and may cause contamination due to incomplete removal. Use of high temperature and pressure for densification of the stacks can damage the fibres.

For making axi-symmetric components, the possible fabrication techniques include: pressing layers of matrix-fibre monolayers, wire winding and fibre coating techniques. In the first case, the process consists of pressing individual foil-fibre mats, where each monolayer is laid in the form of a flat matrix disc. Initially, grooves are etched in the circumferential direction by chemical etching or photolithography. This results in a grooved disc into which a single strand of the fibre is aligned circumferentially, with the help of organic binders. These fibre-matrix monolayers are then hot pressed to obtain a circular composite with the fibres arranged in the circumferential direction, again using high temperature and/or pressure for densification. In this process, the matrix to be used must be available in the form of a sheet. This is not always the case, especially with matrices of low ductility, such as certain aluminides of titanium, nickel or iron. Additionally, the carbonaceous char which may be left behind after the burn-out cycle may result in fabrication problems such as: a) formation of porosity, b) internal matrix oxidation during subsequent heat treatments, resulting in poor mechanical properties; and c) carbon from the char chemically combining with the matrix to form brittle carbides.

In the wire winding process, fibres and matrix in the form of wires are wound onto a mandrel. The winding mechanism requires precision equipment to ensure appropriate spacing and fibre distribution throughout the composite. The matrix wire diameter controls the volume fraction of the fibres. After a suitable thickness has been wound, the entire assembly is encased in a can which is evacuated to a low pressure and hot isostatically pressed (HIP-ed), resulting in an axi-symmetric component. For this process, the matrix material should be available in the form of wires, again limiting the scope of possible matrix materials. This method naturally excludes the use of matrices with lower ductility. Given the nature of winding, the porosity in the preform can be as high as 30%, which may lead to further fibre movement and possible damage during HIP-ing. The can material must be machined off after HIP-ing, thus adding to processing costs.

The third process involves the coating of the reinforcing fibre with the matrix alloy by a high speed deposition process such as the Electron Beam Deposition (EBD). Individual fibre strands are rotated above an alloy bath. The evaporation of the alloy may be achieved in a single step, if the vapour pressures of the alloy constituents are of the order of 1 torr, or by coevaporation of the constituent elements. Coated fibres are used to make a preform of an appropriate shape which is then consolidated by vacuum hot pressing or HIP-ing, to produce a 100% dense material. Similar to the wire winding process, high precision equipment is required to hold and rotate the fibre to ensure an even coating of the matrix alloy around the fibre.

None of the above mentioned techniques have the capability to produce an axi-symmetric component in a single step.

It is an object of the present invention to eliminate the above-mentioned problems associated with the existing fabrication techniques by developing a single step process for manufacturing axi-symmetric fiber-reinforced composite parts.

SUMMARY OF THE INVENTION

According to the invention, a continuous fibre reinforced composite part is fabricated by the simultaneous winding of the fibre and plasma spraying of the matrix onto a rotating mandrel, wherein an axi-symmetric part is produced with multiple layers of the fibres aligned in the circumferential direction. Single or multiple fibre strands are attached/wound onto a mandrel; and simultaneously sprayed with the heated powder matrix material using a thermal spray process. Rotation and translation of the mandrel produces an axi-symmetric composite part.

After the spraying, the part may be subjected to further densification by hot isostatic pressing (HIP-ing) and microstructural modifications via heat treatment, depending on the design requirements specific to the application.

The resulting part has fibre material embedded in the plasma-sprayed matrix the fibre constituting up to 40% of the volume of the part. Speed of rotation and translation of the mandrel control the volume fraction and spacing of the fibres, whereas the geometry of the mandrel controls the shape of the composite produced. Starting with matrix powder and fibres, the light-weight composite part so manufactured contains multiple fibre-matrix layers and the desired shape is produced in a single processing step. The axi-symmetric part produced may be used either directly, or as an insert in other components, with or without further densification. It should be noted that such a composite offers a marked weight reduction compared with conventional materials of comparable strength.

DETAILED DESCRIPTION OF THE INVENTION

Figure 1:
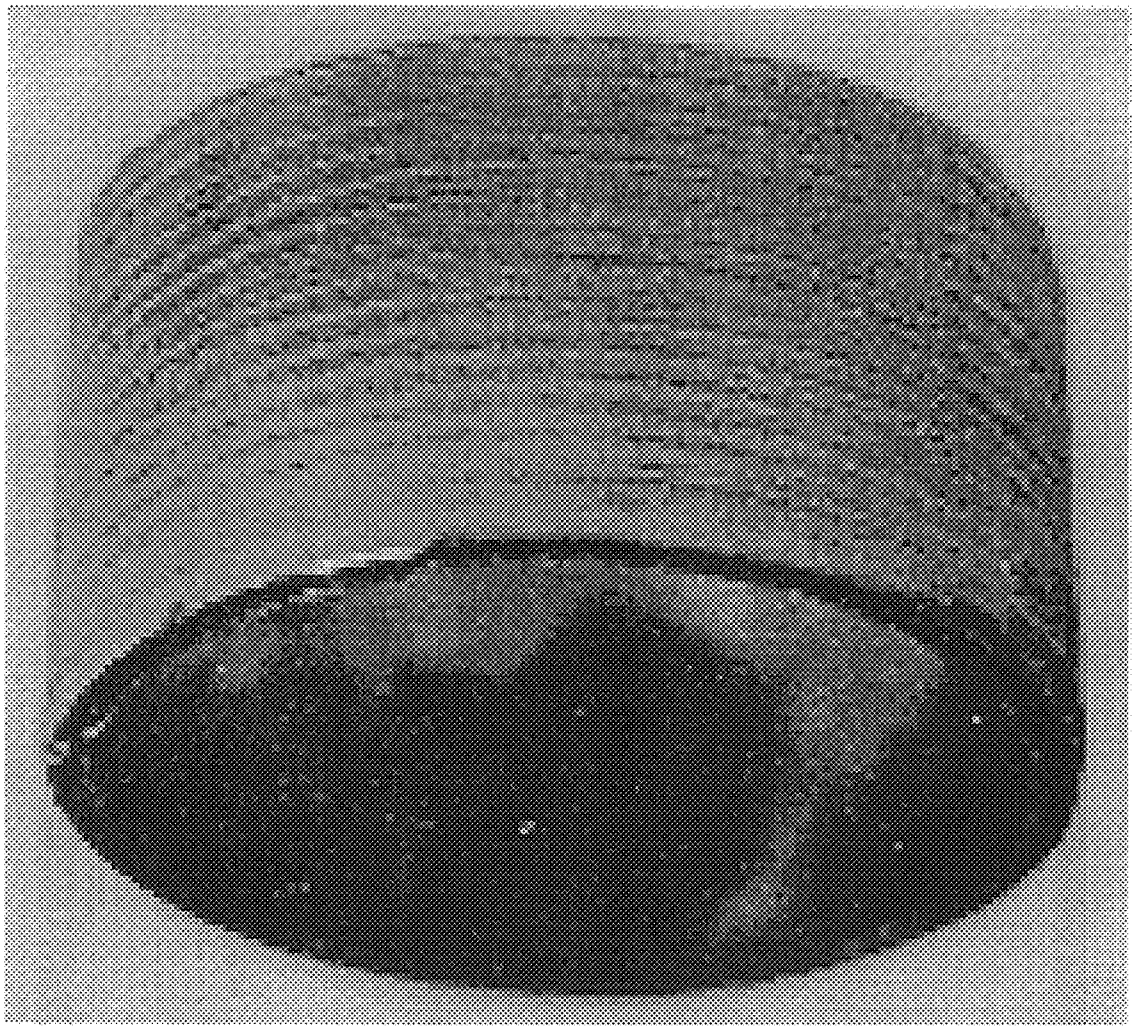
FIG. 1 shows a titanium matrix composite ring prepared by using the method of the invention.

In accordance with the above invention, fibre reinforced composite parts for gas turbine rotating components can be made. By using a continuous one step process, dense reinforced matrices can be deposited to the desired thickness. A wide range of future applications can include selectively reinforced parts, near net shaped parts or any axi-symmetrically rotating or stationary part. The applications can include aerospace components including inserts for blings, blisks, spacers and impellers.

A length of continuous fibre and/or multiple fibre strands is mounted within a thermal spray chamber, for example a vacuum plasma spraying (VPS) facility. The fibre length, which may be mounted on a spool, is fed through a fibre guide and attached to a mandrel made of mild steel, copper, titanium or other suitable mandrel material. The fibre guide allows free passage of the entire fibre onto the mandrel, while maintaining suitable tension on the fibre. The mandrel is attached to a controller unit capable of controlling the speed of rotation and translation of the mandrel. A matrix in the form of powder is initially sprayed onto the mandrel, and subsequently on the substrate of matrix and fibres. The fibre feed mechanism and the plasma torch are preferably stationary, whereas the mandrel rotates and translates, accumulating the sprayed matrix material, along with the fibres and as a result, the composite part is fabricated in a single processing step. An alternative layout is to translate the fibre feed mechanism and the plasma torch relative to a rotating mandrel.

The method of spraying the matrix to fabricate the composite in the said process is controlled by the characteristics of the plasma torch and the type of matrix material. A wide variety of metallic matrix materials, all of which are available in the powder form, are used in the said process, each material having different plasma spraying attributes. This also includes, but is not limited to, the lower ductility matrices such as the aluminides of titanium, nickel or iron.

The initial attachment of the fibre length to the mandrel does not require the use of organic binders, and may be made through a mechanical arrangement. The attachment can be made with a single fibre length, and can be extended to multiple fibre lengths for high fibre volumes. The rotation of the mandrel draws the fibre, while maintaining the tension through the fibre guide.

The matrix powder particles are heated in the plasma to a molten or semi-molten state before they are deposited onto the fibres and rotating mandrel/substrate. On leaving the plasma torch, these semi-molten droplets come in contact with the fibres and cool at a very fast rate. Due to short contact times of the fibres with the semi-molten matrix, fibre-matrix reactions can be virtually eliminated. As the semi-molten matrix cools on the fibres, the fibres are rigidly held in place. This maintains the fibre distribution during subsequent processing, such as diffusion bonding to other components. Reactive matrices, and those matrices which are available in the form of powders can be used by this process to fabricate composites.

The invention has a distinct advantage of manufacturing an axi-symmetric component directly from the raw materials wherein the fibres are arranged in the circumferential direction. A wide variety of compatible fibre/matrix systems can be developed into an axi-symmetric part. Such parts can be used in gas turbine components, inserts for highly stressed parts, rotating machinery or any axi-symmetrically strained component.

The invention eliminates the necessity of preparing a 'green' preform, thereby reducing susceptibility to contamination during subsequent handling. This process enhances the capabilities and broadens the use of the current thermal spray processing. For an operator and end user of thermal spray processed machinery parts, the present invention may be complimentary to the existing monolayer fabrication, and offer the choice of fabricating axi-symmetric and flat parts using similar basic equipment.

The mandrel can be made of copper, mild steel, titanium, superalloys. or other material based on the desired application.

Rejuvenation and repair of existing axi-symmetric components requiring additional stress capabilities can also be performed by this invention.

The mandrel can be a pre-existing engine component for repair/rejuvenation purposes.

Turning now to the drawings, FIG. 1 shows a composite part made according to the invention, i.e. by simultaneous winding of a continuous fibre and plasma spraying of material defined in the Example 1.

Figure 2:
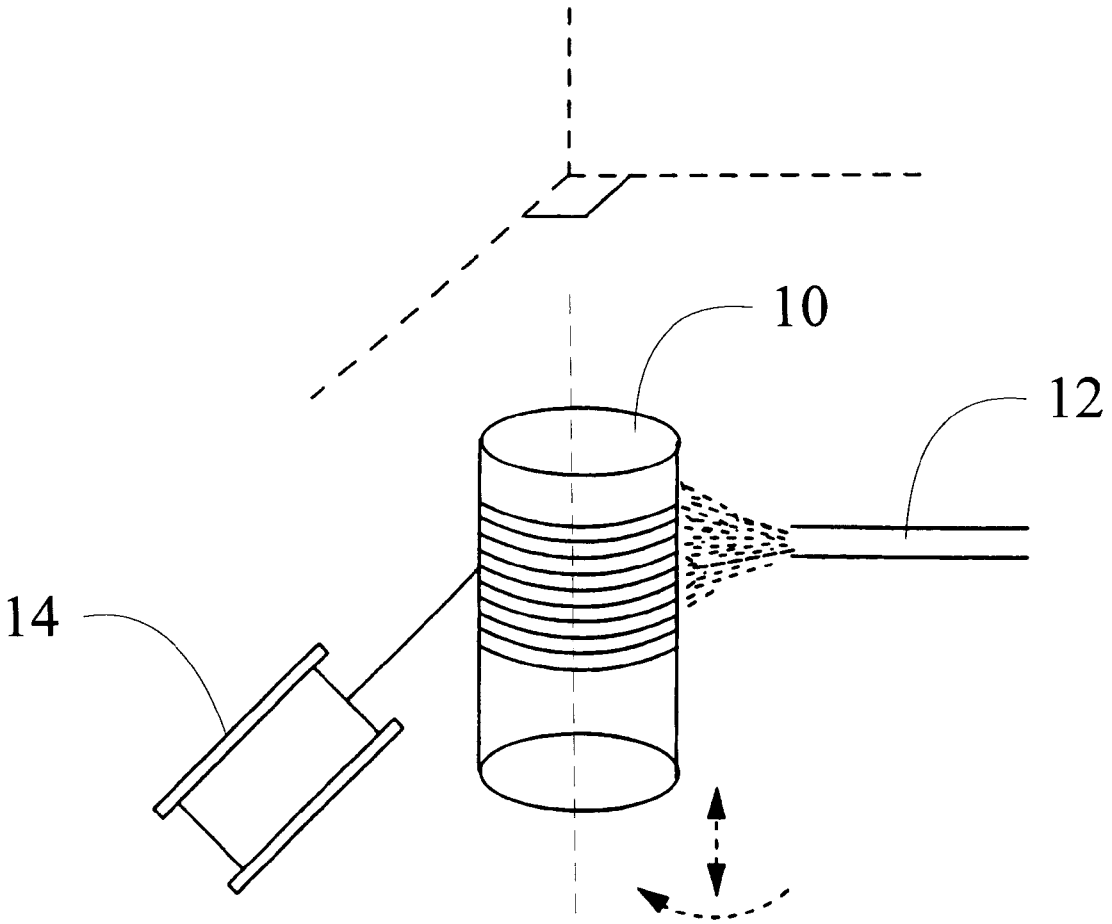
FIG. 2 is a schematic view of an exemplary set-up for carrying out the process of this invention.

FIG. 2 shows a vacuum plasma spraying (VPS) apparatus for manufacturing composite structures. A mandrel 10 is mounted for rotation about its longitudinal axis and for translation along the axis as shown with arrows. A stationary plasma torch 12 and a stationary fibre spool 14 are the other main components. Control means (not shown) are employed to control the rate of rotation and translation, and the effectiveness of the process. The fiber is guided by passing through a hole in a fixed solid element (not shown) positioned close to the mandrel.

Figure 3A:
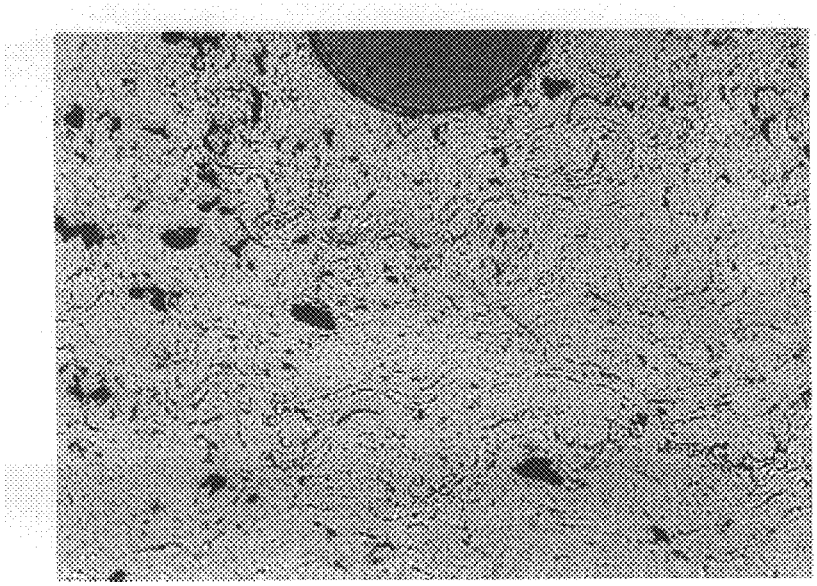
FIG. 3*a* illustrates the as-sprayed microstructure (magnification 240) of the composite ring of FIG. 1.

FIG. 3*a* shows a dense matrix deposition on the fibres of the as-sprayed element of FIG. 1. The material of the fiber and the matrix is as in Example 1. Shown are completely melted particles forming the contours of the matrix layers. There are no interface reactions between the fibres and the matrix. Sporadic large and angular particles form pores which are subsequently removed during a HIP treatment (see FIG. 5).

Figure 3B:
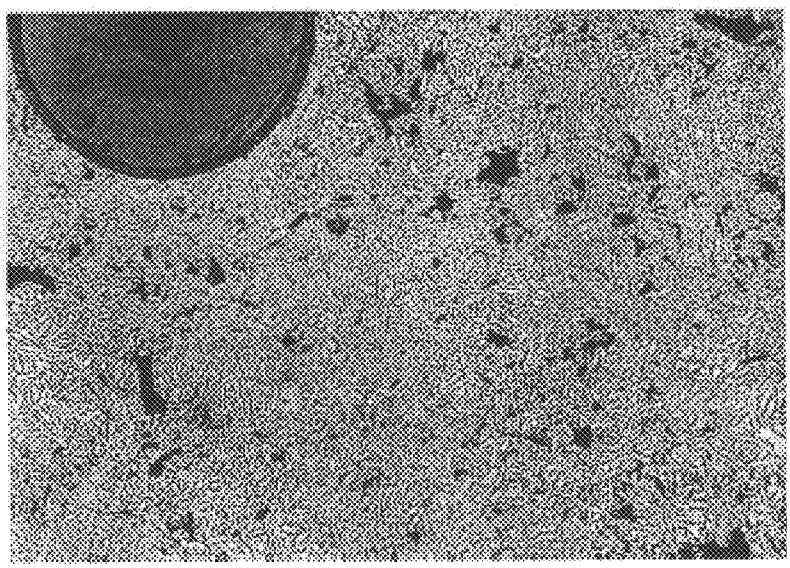
FIG. 3*b* illustrates an etched microstructure (magnification 300) of the composite ring of FIG. 1.

FIG. 3*b* shows an etched microstructure of the composite ring of FIG. 1 (Example 1). The fineness of the microstructure results from the rapid cooling of the matrix particles upon contact with the rotating substrate. The sample shows no symptoms of interface reactions.

Figure 4:
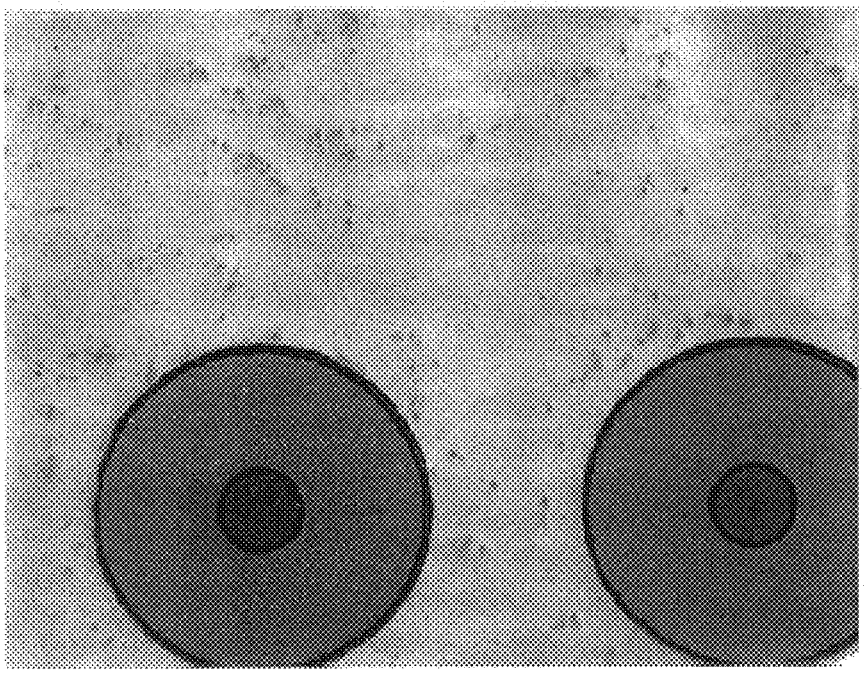
FIG. 4 is a micrograph (X 300) of the ring of FIG. 1 after a hot isostatic pressing (HIP) cycle.

FIG. 4 is a micrograph of the fabricated ring after a HIP cycle. The porosity is virtually eliminated (less than 1%). No interface reactions are observed.

Figure 5:
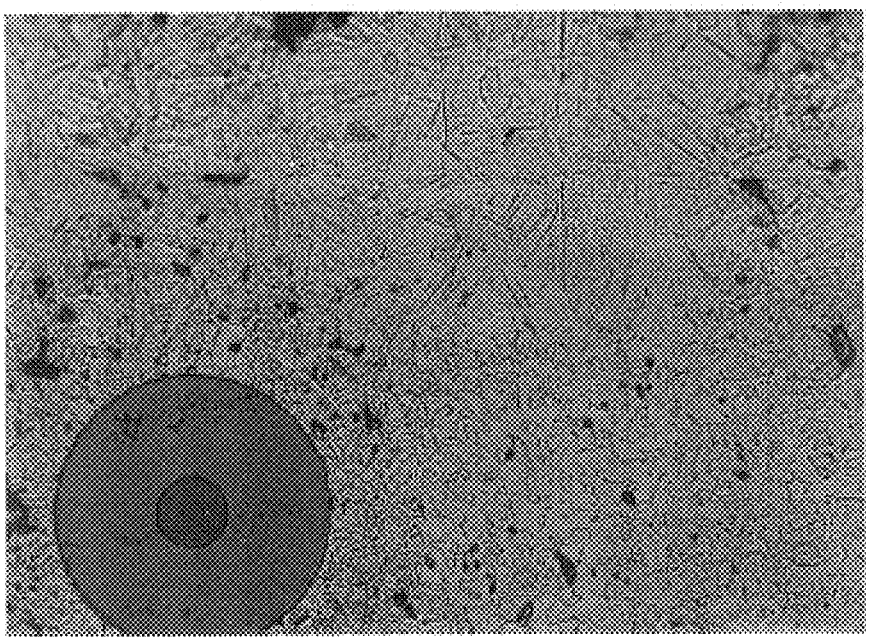
FIG. 5 is the microstructure (X300) of the composite ring as shown in FIG. 1 after heat treatment at 950° C. for 2 hours.

FIG. 5 is the microstructure after a heat treatment at 950° C. and 2h of the composite ring as shown in FIG. 1.

Any rotating shafts, rings and spacers for automobile and other devices can be manufactured by this invention using a compatible fibre matrix system. For aerospace applications, such as an insert for a compressor disk, a ring can be prepared as shown in the following examples:

EXAMPLE 1

A Ti-6Al-4V/SCS-6 ring was prepared similar to that shown in FIG. 1. The SCS-6 silicon carbide fibres were obtained from Textron Specialty Materials, Lowell, Mass. The matrix material (Ti-6Al-4V) was obtained from Micron Materials Inc. The ring was 4 mm thick, 5 cm in diameter, with 20 layers of fibre/matrix. The mandrel in this case was a copper tube. The entire composite part was fabricated in less than 15 minutes, in a single step.

EXAMPLE 2

The ring as prepared in example 1, was subjected to a HIP cycle at 30 ksi and 870° C. The product is shown in FIG. 4. A fully dense matrix was obtained with no damage to the fibre or the fibre coating.

EXAMPLE 3

The HIP-ed ring of Example 2 was heat treated at 950° C. for two hours to modify the microstructure to yield properties suitable for a particular application. The resulting microstructure is shown in FIG. 5. The microstructure shows no symptoms of interface reactions.

EXAMPLE 4

A ring was prepared as in example 1 and as shown in FIG. 1 where the rotation of the target mandrel was set at 60 rpm with a translation motion of 2 mm/s. The powder feed rate was set at 22.6 g/min of a 70–100 $\mu$m particle sized powder, with a total of 5 passes of spray. Each pass consists of one complete upward and one complete downward longitudinal motion.

We claim:

1. A method to manufacture continuous fibre reinforced axi-symmetric composites, the method comprising the following steps:

a) providing a mandrel having a surface, b) providing a spray of molten metallic material and directing it onto the surface of the mandrel, and c) simultaneously and continuously depositing a reinforcing fiber and spraying said fiber around said mandrel with said molten metallic material to form a structure having multiple layers of fibers embedded in a matrix of said metallic material on said mandrel.

2. The method of claim 1 wherein said metallic material is a titanium alloy.

3. The method of claim 1 wherein said fiber is a silicon carbide fiber.

4. The method of claim 1 wherein said spray of molten material is effected by plasma spraying.

5. The method of claim 1 wherein said spray is stationary while said mandrel is rotated and translated along a major axis thereof during the depositing.

6. The method of claim 1, where the mandrel is of a material selected from the group consisting of copper, mild steel, titanium or superalloys.

7. The method of claim 1, where the mandrel is a pre-existing engine component for repair/rejuvenation purposes.

8. The method of claim 1 further comprising the step of subjecting said structure to an after-treatment by hot isostatic pressing and/or thermal treatment.

9. A method to manufacture continuous fibre reinforced axi-symmetric composites, the method comprising the following steps:

a) providing a mandrel, b) providing a plasma spray means for spraying a molten metallic material, c) proving a source of reinforcing fibers, d) simultaneously and continuously depositing said reinforcing fibers and spraying said fibers around said mandrel with said molten metallic material to form a composite having multiple layers of fibers embedded in a matrix of said metallic material on said mandrel, and e) separating the composite from said mandrel.

10. The method of claim 9 wherein during said depositing, said mandrel is rotating, and said source of said fibers and said plasma spray means are translated parallel to a major axis of said mandrel.

11. The method of claim 9 further comprising the step of subjecting said structure to an after-treatment by hot isostatic pressing and/or thermal treatment.

* * * * *